US005723944A

United States Patent [19]

Higashi et al.

[11] Patent Number: 5,723,944

[45] Date of Patent: Mar. 3, 1998

[54] METAL HALIDE LAMP OF THE SHORT ARC TYPE

[75] Inventors: Tadatoshi Higashi, Himeji; Tomoyoshi Arimoto, Tatsuno, both of Japan

[73] Assignee: Ushiodenki Kabushiki Kaisha, Tokyo, Japan

[21] Appl. No.: 562,984

[22] Filed: Nov. 27, 1995

[30] Foreign Application Priority Data

Nov. 25, 1994 [JP] Japan ..... 6-314350
Dec. 22, 1994 [JP] Japan ..... 6-335346

[51] Int. Cl.[6] ..... H01J 17/04

[52] U.S. Cl. ..... 313/570; 313/621; 313/631

[58] Field of Search ..... 313/570, 571, 313/572, 573, 574, 620, 621, 631, 632

[56] References Cited

U.S. PATENT DOCUMENTS 4,906,895 3/1990 Pabst et al. ..... 313/632
4,937,496 6/1990 Neiger et al. ..... 313/632

*Primary Examiner*—Sandra L. O'Shea
*Assistant Examiner*—Vip Patel
*Attorney, Agent, or Firm*—Sixbey, Friedman, Leedom & Ferguson; David S. Safran

[57] ABSTRACT

To minimize "color hue" and "flickering" on an irradiated surface such as a screen or the like, is achieved by the fact that, in a metal halide lamp of the short arc type which has a cathode and an anode in which at least rare earth halides and mercury are encapsulated and which is operated with an essentially horizontal discharge direction using direct current power, the cathode has a tungsten electrode shaft about which a tungsten coil is wound, and the relationship $0.029<S/I<0.076$ is satisfied where S is the cross section of the electrode shaft ($mm^2$) and I the current in steady-state luminous operation (A). In accordance with another aspect of the invention, the lamp is operable with a current I (amperes) in steady-state luminous operation in a range from $1.6<I<5.0$ and the anode has a tip formed of a roughly cylindrical rod with a bevelled edge between a blunt end of the rod and a peripheral surface of the rod, and with the relationship of the current I and the area S of the blunt end ($mm^{2)}$ $0.045<S/I<0.08$ being satisfied.

6 Claims, 3 Drawing Sheets

METAL HALIDE LAMP OF THE SHORT ARC TYPE

BACKGROUND OF THE INVENTION

1. Field of the Invention

The invention relates to a metal halide lamp of the short arc type. The invention relates especially to a metal halide lamp of the short arc type which is used as a light source for a display of the liquid crystal projection type.

2. Description of the Prior Art

Recently, a metal halide lamp of the short arc type with high efficiency and good color reproduction has been used as a light source for a display of the liquid crystal projection type, in which halides of the rare earths, such as dysprosium, neodymium and the like, are encapsulated.

Due to the need for high brightness, this lamp is operated with a high load of 35 W/cm$^2$ to 80 W/cm$^2$. The arc tube of quartz glass reaches a high temperature of at least 900° C. Therefore, the problem arises that, in luminous operation lasting roughly a few hundred hours, a milky cloudiness of the arc tube arises.

If the lamp is used for optical purposes, the occurrence of the milky cloudiness greatly impairs the efficiency of the light; in practice, this means the end of usability of the lamp.

On the other hand, as a process for operating a metal halide lamp of the short arc type, luminous operation by alternating current with waves of an acutely angled shape a frequency of 250 Hz to 500 Hz is generally used for practical purposes. However, a process for luminous operation using direct current is also proposed as a process for suppressing milky cloudiness.

A major effect of suppressing milky cloudiness is obtained if luminous operation using direct current is accomplished with a horizontal discharge direction, as the present inventors have already reported at the national conference of the Japanese Illumination Association in 1993 (in paper No. 24). In this case, the polarization phenomenon (cataphoresis phenomenon) of the emission material conventionally considered adverse, which occurs in luminous operation using direct current and which can also be called enrichment or accumulation on a certain side, is used positively for suppression of the milky cloudiness.

This means that, due to the phenomenon by which luminous operation using direct current attracts rare earth ions or atoms toward the cathode, and that as a result thereof, a gradient of the density of the rare earth atoms is formed from the cathode to the anode, and especially by the action of uninterrupted attraction of the ions or atoms by the cathode, the inventors have been able to reduce the number of ions or atoms of rare earths or neutral atoms which reach as far as the tube wall, and thus, reduce the occurrence of milky cloudiness in a revolutionary manner.

By means of this luminous operation using direct current with a horizontal discharge direction, the "milky cloudiness" can be advantageously suppressed. However, when used as the light source of a display of the liquid crystal projection type, it is necessary, furthermore, to eliminate the "color hue" on the screen and "flickering" due to the instability of the arc.

SUMMARY OF THE INVENTION

Therefore, a primary object of the invention is to minimize "color hue" and "flickering" on an irradiated surface, such as a screen or the like, in a metal halide lamp of the short arc type for luminous operation using direct current.

This object is achieved according to the invention in a metal halide lamp of the short arc type which has a cathode and an anode in which at least rare earth halides and mercury are encapsulated, and which is operated with an essentially horizontal discharge direction using direct current power by the following features:

(1) The cathode has an arrangement in which a tungsten electrode shaft is wound with a tungsten coil. If the cross sectional area of this electrode shaft is designated S (mm$^2$) and the current in steady-state luminous operation is designated I (A), the relationship $0.029<S/I<0.076$ is satisfied.

(2) Furthermore, in the case of (1), the tip of the electrode shaft of the cathode has a length which is at least twice the size of the diameter of the electrode shaft and it projects out of the coil.

(3) Furthermore, this lamp is combined with a reflector by which a light source device is formed which is suitable as a light source for a display of the liquid crystal projection type.

(4) As a development of the invention, during steady-state luminous operation of the lamp, the lamp current I (A) is maintained in a range of $1.6<I<5.0$. In this case, the tip part of the anode is formed of a cylindrical rod in which edges have been bevelled and a blunt end has partially been left. Furthermore, with an area of this blunt end S (mm$^2$) and current I (A), the relationship $0.045<S/I<0.08$ is satisfied.

(5) Furthermore, in the case of (4), the tip part of the anode has a bevel angle that is greater than or equal to 45 degrees.

(6) In addition, this lamp is combined with a reflector, by which a light source device is formed which is suitable for a light source for a display of the liquid crystal projection type.

As the result of various tests, the inventors have ascertained that advantageous luminous operation with only low "color hue" and only low "flicker" can be accomplished by designing the cathode to satisfy relationship $0.029<S/I<0.076$, where I is the lamp current in amps and S is the cross-sectional area of the electrode shaft of the cathode in mm$^2$. Furthermore, they also found that it is a good idea to fix the length of the electrode projection.

In addition, the inventors have also taken into account the anode and found that the same effect can be achieved by the anode tip having a shape in which a blunt end with a certain area is left and edges are bevelled, and by fixing the ratio between the area S of the flat part of the anode tip and the lamp current at $0.045<S/I<0.08$.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
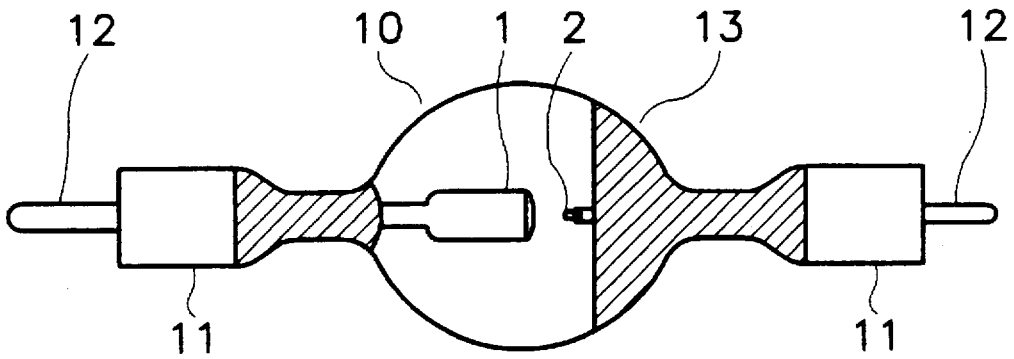
FIG. 1 schematically shows a partial cross section of a lamp according to an embodiment of the invention.

FIG. 1 schematically shows a first lamp according to the invention which comprises an arc tube 10 made of quartz glass, within which an anode 1 and a cathode 2 are disposed opposite one another, and within which an inert gas and mercury, as well as rare earth halides, are encapsulated. Cesium halide, indium halide, and tin halide are encapsulated as these rare earth halides. On each end of arc tube 10, there is a hermetically sealing part 11, and from which an external connection 12 extends. A heat insulating film 13 is applied to an outer surface of arc tube 10.

Figure 2:
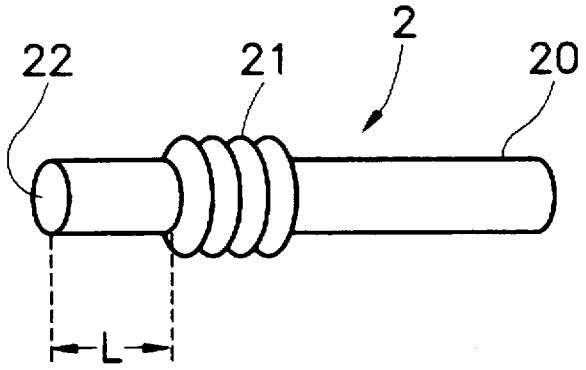
FIG. 2 is a schematic perspective view of the cathode of the lamp shown in FIG. 1.

FIG. 2 schematically shows cathode 2 enlarged. Cathode 2 is formed such that a tungsten coil 21 is wound about its electrode shaft 20, that is formed mainly of tungsten, at a distance from tip 22 of the electrode shaft 20 having a length L. The size of this cathode 2 is set such that the relationship $0.029<S/I<0.076$ is satisfied where S is the cross-sectional area of the electrode shaft 20 ($mm^2$) and I is the nominal lamp current I (A), as is described below. Furthermore, the length L of the distance that the tip 22 of the electrode shaft 20 projects from the tungsten coil 21 is at least twice as great as the outer diameter of the electrode shaft 20.

In the following, specific numerical values of this lamp are given by way of example only. The lamp is operated, for example, with a nominal power of 125 W using direct current, such that the discharge direction becomes horizontal. The arc tube 10 has a maximum diameter of 7.5 mm, an inner volume of 0.3 $cm^3$ and anode 1 and cathode 2 are located opposite one another with a distance of roughly 3 mm between them. For cathode 2, the electrode shaft 20 has a diameter of 0.35 mm and a total length of the shaft portion that is wound with tungsten coil 21 is 8 mm, the coil 21 being formed of four turns of a tungsten wire having a diameter of 0.3 mm. Tip 22 projects out of coil 21 distance having a length of 1.0 mm is in the form of a planar blunt end.

Encapsulated in arc tube 10 are 14 mg of mercury, 0.4 mg of a mixture of halides of the rare earths which contain dysprosium iodide and of cesium iodide, 0.3 mg of indium iodide, and furthermore, 150 torr of argon gas at room temperature.

In luminous operation of this lamp with a direct current of 125 W and a horizontal discharge direction, the lamp voltage was 68 V, the lamp current was 1.84 A, the luminous efficiency was 64 lumen/W and the color temperature was 7350° K. Furthermore, the above described S/I relationship, determined by cross sectional area S of the electrode shaft and the value of the lamp current I, was 0.052. Five lamps with this specification were produced and illumination-tested. Here, it was ascertained that, even after 2000 hours, luminous operation is stable and the milky cloudiness, color hue and the flicker is limited to a degree which is acceptable for practical use.

Next, tests were run changing the value of S/I which is established by cross sectional area S of the electrode shaft and lamp current value I. The lamps used were the same as the above described lamps except for changes of the diameter of the electrode shaft, and they were operated under the same conditions indicated above. First, a lamp with a diameter of the electrode shaft of 0.3 mm (S/I=0.038) and a lamp with an electrode shaft diameter of 0.4 mm (S/I=0.68) were used, and the test was run in the same manner by luminous operation of the lamps for 2000 hours. Here, it was ascertained that a good result is, likewise, obtained.

In the case in which the test was run using a lamp with a diameter of the electrode shaft of 0.5 mm (S/I=0.086), however, during luminous operation movements of bright spots which are formed between the electrodes were caused. Consequently, flickering occurred in the light emitted from the lamp.

Furthermore, in the case in which the test was run using a lamp with a diameter of the electrode shaft of 0.25 mm (S/I=0.026), the disadvantage was engendered that, as the result of the high current when luminous operation was started, the tip of the electrode shaft was worn.

In the following, a lamp with an input electric power of 250 W is described as a second embodiment. Arc tube 10 has a maximum inside diameter of 10.5 mm and an inner volume of 1.0 $cm^3$, and the anode 1 was located opposite the cathode 2 at a distance of roughly 3.0 mm therefrom.

For cathode 2, an electrode shaft 20 with a diameter of 0.4 mm has a tungsten coil 21 with a diameter of 0.3 mm positioned thereon such that tip 22 projects from the coil 21 a distance having a length L of 1.0 mm.

Within arc tube 10, a 0.45 mg pellet in which dysprosium iodide, cadmium iodide and cesium iodide with a molecular ratio of 1:1:1 were mixed, 0.8 mg of indium iodide, 44 mg of mercury and 150 torr argon gas at room temperature were encapsulated. With this lamp, at an initial voltage of 64 V, the lamp current was 3.91 A, the luminous efficiency was 66 lumen/W and the color temperature was 7200° K.

Three lamps with this specification were operated with a horizontal discharge direction for 1500 hours. In doing so, the discharge remained stable, and the milky cloudiness could be recognized only to a small degree on the upper wall of arc tube 10. Thus, a characteristic which can be used to a sufficient degree for practical purposes was shown. The S/I in this case was 0.032.

Next, a test was run by changing the value of S/I which is established by cross-sectional area S of the electrode shaft and the lamp current value I.

The same lamp as the above described lamp with the same conditions except for changes of the diameter of the electrode shaft was used.

At a diameter of 0.5 mm (S/I=0.0502) of the electrode shaft, a good result was, likewise, obtained also when luminous operation was continued for 1500 hours.

In the case where the electrode shaft had a diameter of 0.65 mm (S/I=0.0848), however, flicker occurred in two lamps out of four, and it was confirmed that advantageous luminous operation could not be obtained.

Furthermore, in the case in which the diameter of the electrode shaft was 0.3 mm (S/I=0.0175), even for luminous operation lasting roughly 100 hours, wear of tip 22 of the electrode shaft clearly occurred. In addition, in the case in which length L of the projection of tip 22 of electrode shaft 20 was 0.6 mm, the disadvantage arose that bright spots occurred in one part in the vicinity of coil 21.

As a result of the fact that a test of this type was repeatedly run the diameter of the electrode shaft and the lamp current variously changed, it was ascertained that good luminous operation can be accomplished if the value of S/I is greater than 0.029 and less than 0.076.

Furthermore, it was found that it is desirable that the length L that the tip of the electrode shaft projects is at least twice the size of the diameter of the electrode shaft. This is because there are cases in which the bright spots which are to be formed between the electrodes arise at a projecting length L of 0.5 mm in the part in the vicinity of the coil, even if the diameter of the electrode shaft is 0.3 mm and S/I is within the above described range of numerical values.

In the following, another embodiment of a metal halide lamp of the short arc type is described.

In a first form of this embodiment, a lamp with an input electric power of 125 W is described. The lamp has the same arrangement as in FIG. 1, arc tube 10 having a maximum inside diameter of 7.5 mm and an inner volume of 0.3 $cm^3$.

Figure 3:
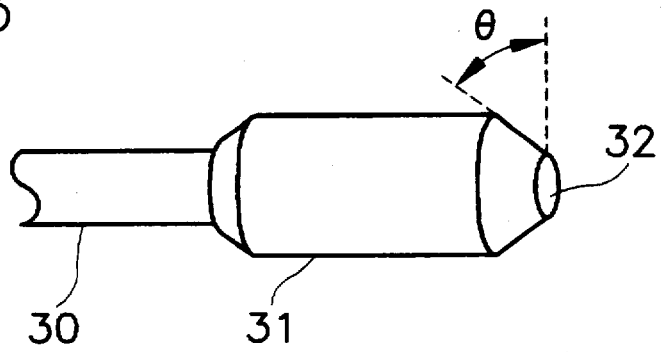
FIG. 3 is a schematic perspective view of the anode of the lamp shown in FIG. 1.

FIG. 3 schematically shows anode 1 enlarged. A main part 31 of the anode 1 has an essentially cylindrical shape, is formed of tungsten, has a diameter that is greater than that of electrode shaft 30, and is connected to the tip of the electrode shaft 30. The tip part of the main part 31 of anode has a form with a flat part 32 having a predetermined area and with bevelled edges. The tip part faces the cathode and is connected to the main part 31 via the bevelled edges. The size of this anode 1 is such that the value of S/I is greater than 0.045 and less than 0.08 for lamp current I in the range of from 1.6 A to 4.5 A where S is the area of flat part 32 in $mm^2$, as is described below. Furthermore, it is desirable that the bevel form an angle θ with respect to the plane of the tip surface 32 that is greater than or equal to 45°.

Figure 4:
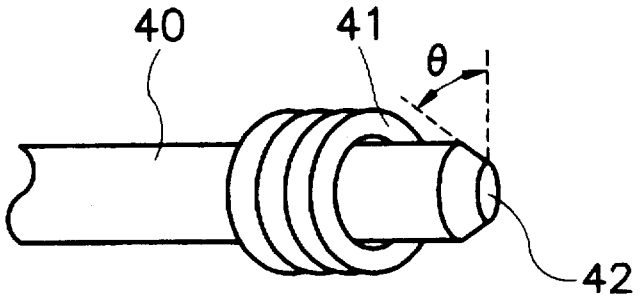
FIG. 4 is a schematic perspective view of an alternative anode of the lamp according to the invention.

The arrangement of the anode is, furthermore, not limited to only the arrangement shown in FIG. 3, where one part has a large diameter and one part has a small diameter, but it can also have a shape in which tungsten anode shaft 40 is wound with tungsten coil 41, as is shown in FIG. 4. In this case as well, the tip part has a form with a flat part 42 having a predetermined area with bevelled edges, and faces the cathode and beveled edges.

Specifically, for example, the diameter of main part 31 of the anode was 1.5 mm, the diameter of flat part 32 was 0.35 mm and the cut angle θ is 45 degrees.

Within arc tube 10 are encapsulated 0.4 mg of a mixture in which dysprosium iodide, neodymium iodide and cesium iodide with a molecular ratio of 1.6:1:1.33 were mixed, 0.3 mg of monovalent indium iodide, 15 mg of mercury and 150 torr argon gas at room temperature. This lamp was installed in a reflector and operated with a direct current power of 125 W. The lamp voltage was 62 V, the lamp current was 2 amps, and ratio S/I between lamp current I and area S of flat part 32 was 0.048 ($mm^2$/A). For 2000 hours of luminous operation of this lamp, no milky cloudiness or the like occurred in the arc tube, and roughly 80% of the initial light flux on the screen was maintained. Also, flickering of the light did not occur.

For a lamp with the same specification as this lamp having a diameter of the flat part 32 of the anode of 0.5 mm (S/I=0.098 $mm^2$/A), the bright spots which formed between the electrodes move, and instability of the discharge and flickering of the light occurred. Furthermore, using an anode with a diameter of the flat part of 0.3 mm for 1000 hours of luminous operation, wear and deformation of the anode tip occurred to a considerable degree (S/I=0.035 $mm^2$/A).

In the following, a lamp with an input electric power of 150 W is described as a second form of this embodiment. Arc tube 10 has a maximum inside diameter of 8.5 mm and an inner volume of 0.4 $cm^3$, and within arc tube 10 are tungsten anode 1 and cathode 2 located opposite one another with a distance of roughly 2.5 mm between them. The main part 31 of anode 1 has a diameter of 1.6 mm, and the diameter of the flat part 32 of the anode tip is 0.4 mm.

Within arc tube 10, 0.5 mg of a mixture in which dysprosium iodide, neodymium iodide and cesium iodide with a molecular ratio of 1.6:1:1.33 were mixed, 0.4 mg of monovalent indium iodide, 20 mg of mercury and 150 torr argon gas at room temperature are encapsulated.

This lamp was operated with 150 W using direct current. The lamp voltage was 60 V and the lamp current was 2.5 amps (S/I=0.05 $mm^2$/A). For 2000 hours of luminous operation of this lamp, no milky cloudiness occurred in the arc tube, and 75% of the initial value in luminous operation of the lamp on the screen was maintained. Flickering of the light did not occur, and a good characteristic was shown.

On the other hand, in the case in which the diameter of the flat part of the tip of this anode was 0.6 mm (S/I=0.113 $mm^2$/A), the bright spots which had formed between the electrodes moved, instability of the discharge and flickering occurred. Furthermore, using an anode with a diameter of the flat part of the tip of 0.3 mm (S/I=0.028 $mm^2$/A) for luminous operation of 1000 hours, wear and deformation of the anode tip occurred to a considerable degree.

In the following, a lamp with an input electric power of 250 W is described as a third from of the embodiment. Arc tube 10 had a maximum inside diameter of 10.5 mm and an inner volume of 1.0 $cm^3$, and within the arc tube 10, a tungsten anode 1 and cathode 2 were located opposite one another with a distance of roughly 3.0 mm therebetween. The diameter of the main part 31 of the anode 1 was 2.2 mm, and the diameter of the flat part 32 of the tip was 0.5 mm.

In arc tube 10, 0.7 mg of a mixture in which dysprosium iodide, neodymium iodide and cesium iodide with a molecular ratio of 1.6:1:1.33 were mixed, 0.8 mg of monovalent indium iodide, 50 mg of mercury and 150 torr argon gas at room temperature are encapsulated.

In 150 W luminous operation of this lamp using direct current, the lamp voltage was 66 V and the lamp current was 3.8 amps (S/I=0.051 $mm^2$/A). At a time of luminous operation of this lamp of 2000 hours, no milky cloudiness occurred in the arc tube, and 65% of the screen light flux was maintained. Flickering of the light did not occur, and an extremely good service life characteristic was shown.

However, in the case in which, for this lamp in the initial test, an electrode was used with a diameter of the flat part of the electrode tip of 0.8 mm (S/I=0.132 $mm^2$/A), the bright spots moved, instability of the discharge and flickering occurred. Furthermore, using an anode with a diameter of the flat part of the tip of 0.4 mm (S/I=0.033 $mm^2$/A), for luminous operation of 1000 hours, wear and deformation of the anode tip part occurred to a considerable degree.

Figure 5:
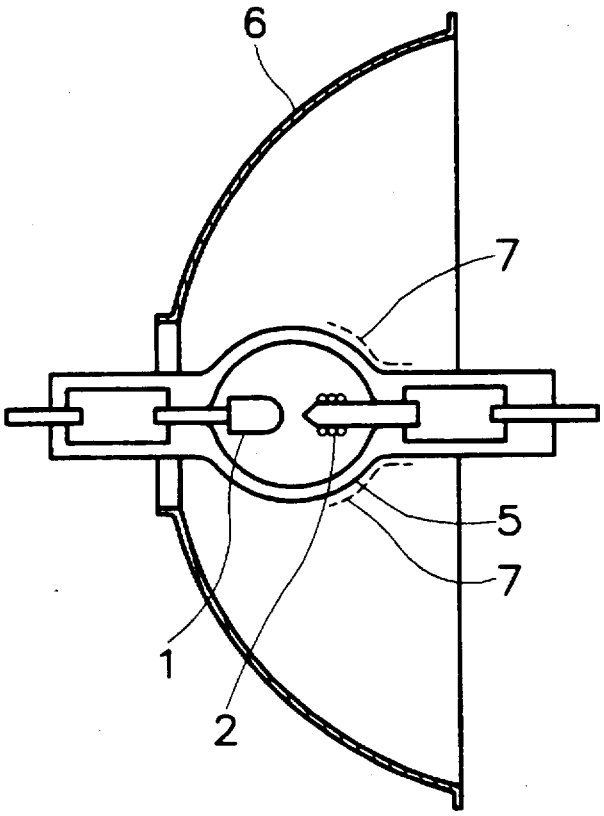
FIG. 5 shows a schematic of the optical device according to the invention.

FIG. 5 is a schematic depiction of a light source device using a metal halide lamp of the short arc type according to the invention.

In the drawing reference, a lamp 5 is located in a reflector 6 such that the optical axis thereof agrees with the direction of its arc axis. Radiant light from lamp 5 is reflected directly or by means of reflector 6, and via a liquid crystal not shown in the drawing or the like, it is emitted onto a screen.

As described above, good irradiation of the screen without "color hue" or "flickering" can be achieved by the measure by which ratio S/I between lamp current I and cross-sectional area S of electrode shaft is selected to be greater than 0.029 and less than 0.076, or by the measure by which ratio S/I between lamp current I and area S of the flat part of the anode tip is selected to be greater than 0.045 and less than 0.08.

In this combination of lamp 5 with reflector 6, by the measure in which cathode 2 is located on the open side of reflector 6 and in which, at the same time, there a frost 7 is provided on the outer surface of the arc tube 10 proceeding a set distance from the base of the cathode 2, by the arc formed between the electrodes, light produced on the anode side is emitted which has relatively uniform emission colors without passing through the frosted surface, while light which is produced on the cathode side and which has relatively high brightness is scattered by the frosted surface and can irradiate the screen or the like. By this measure, the color hue on the irradiated area can be eliminated even more advantageously. It is necessary that the area which is frosted specifically covers from the base of the cathode at least ¼ and no more than ¾ of the arc length.

Figure 6:
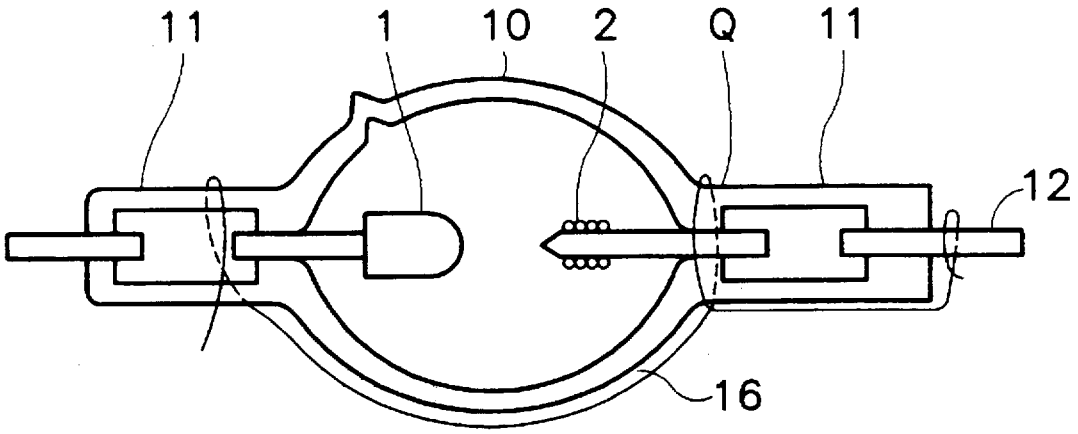
FIG. 6 is a schematic side view of another lamp according to the invention.

Furthermore, the metal halide lamp of the short arc type according to the invention, as is illustrated in FIG. 6, has a trigger wire 16. One end of trigger wire 16 is connected to the external connection 12 on the cathode side, and the other end of this trigger wire 16 is connected to hermetically sealing part 11 on the anode side. By the action of trigger wire 16, starting of luminous operation of the lamp can be simplified.

In addition, the disadvantage of cracking of arc tube 10 can be eliminated by the measure by which, in hermetically sealing part 11, on the anode side, a site is wound with trigger wire 16 which is greater than or equal to 3 mm from the flaring part of arc tube 10 in a direction toward the external connection side of the anode.

It is to be understood that, although preferred embodiments of the invention have been described, various other embodiments and variations may occur to those skilled in the art. Any such other embodiments and variations which fall within the scope and spirit of the present invention are intended to be covered by the following claims.

What we claim is:

1. A short arc metal halide lamp which is operated with an essentially horizontal discharge direction using direct current power, comprising a lamp tube in which a cathode, an anode, at least rare earth halides and mercury are encapsulated; wherein said cathode has a tungsten electrode shaft with a tungsten coil wound thereon; and wherein a relationship $0.029<S/I<0.076$ is satisfied, where S is a cross-sectional area of the electrode shaft in $mm^1$ and I is an operating current in amperes of the lamp during steady-state luminous operation.

2. A short arc metal halide lamp according to claim 1, wherein a tip of said electrode shaft is spaced from said tungsten coil by a distance having a length which is at least twice a diameter of the electrode shaft.

3. Light source device which has a short arc metal halide lamp which is operated with an essentially horizontal discharge direction using direct current power, comprising a lamp tube in which a cathode, an anode, at least rare earth halides and mercury are encapsulated, and a reflector means for reflecting light emitted from said lamp and in which the lamp is positioned an axis thereof aligned with an optical axis of the device; and wherein the cathode of the lamp has a tungsten electrode shaft with a tungsten coil wound thereon; and wherein a relationship $0.029<S/I<0.076$ is satisfied, where S is a cross-sectional area of the electrode shaft in $mm^2$ and I is an operating current in amperes of the lamp during steady-state luminous operation.

4. A short arc metal halide lamp which is operated with an essentially horizontal discharge direction using direct current power, comprising a lamp tube in which a cathode, an anode, at least rare earth halides and mercury are encapsulated; wherein the lamp is operable with a current I (amperes) in steady-state luminous operation in a range from $1.6<I<5.0$; wherein the anode has a tip formed of a roughly cylindrical rod, a bevelled edge being provided between a blunt end of the rod and a peripheral surface of the rod; and a relationship $0.045<S/I<0.08$ is satisfied where S is an area of the blunt end in $mm^2$.

5. A short arc metal halide lamp according to claim 4, wherein said bevelled edge is at an cut angle relative to a plane of said blunt end which is at least 45°.

6. Light source device which has a short arc metal halide lamp which is operated with an essentially horizontal discharge direction using direct current power, comprising a lamp tube in which a cathode, an anode, at least rare earth halides and mercury are encapsulated, and a reflector means for reflecting light emitted from said lamp and in which the lamp is positioned an axis thereof aligned with an optical axis of the device; and wherein the lamp is operable with a current I (amperes) in steady-state luminous operation in a range from $1.6<I<5.0$; wherein the anode has a tip formed of a roughly cylindrical rod, a bevelled edge being provided between a blunt end of the rod and a peripheral surface of the rod; and a relationship $0.045<S/I<0.08$ is satisfied where S is an area of the blunt end in $mm^2$.

* * * * *